United States Patent [19]

Richardson

[11] 4,208,766

[45] Jun. 24, 1980

[54] ELECTRIC CLUTCH FEEDER DRIVE FOR SEED COTTON PROCESSING MACHINERY

[75] Inventor: Arthur H. Richardson, East Bridgewater, Mass.

[73] Assignee: Murray-Carver, Inc., Dallas, Tex.

[21] Appl. No.: 924,334

[22] Filed: Jul. 13, 1978

[51] Int. Cl.[2] ..... D01B 1/08

[52] U.S. Cl. ..... 19/64.5

[58] Field of Search ..... 19/55 R, 55 A, 55 B, 19/48 R, 64.5, 0.25, 97.5, 105, 204

[56] References Cited

U.S. PATENT DOCUMENTS

| | | | |
|---|---|---|---|
| 823,439 | 6/1906 | Reynolds | 19/55 R |
| 1,069,413 | 8/1913 | Grimes | 19/64.5 |
| 3,295,170 | 1/1967 | Whitehurst | 19/0.25 X |

*Primary Examiner*—Louis Rimrodt

*Attorney, Agent, or Firm*—James Creighton Wray

[57] ABSTRACT

Cottonseed processing machinery has an automatic variable speed feeder. Cottonseed flows through a chute into a hopper and out of the hopper onto a gratefall adjacent turning saw blades. A curved section coextensive with the gratefall overlies the gratefall and urges the cottonseed toward the gratefall and saw blades. The sensing means of a switch detects movement of a weighted arm urging the curved section toward the gratefall. A float shaft is rotated between the gratefall and the curved section in the cottonseed roll. Pulleys drive one part of an electric clutch from the clutch shaft. The other part of the electric clutch when energized connected the first part to the speed reducer which in turn drives the feed roll shaft. When the limit switch senses movement of the arm, indicating a movement of the curved section toward the gratefall, a reduced cottonseed roll, and the need for faster feed, the switch energizes the clutch, driving the feed roll from the float roll via the electric clutch and speed reducer. When the curved section returns outward, the switch causes the clutch to disengage.

6 Claims, 4 Drawing Figures

FIG. 3
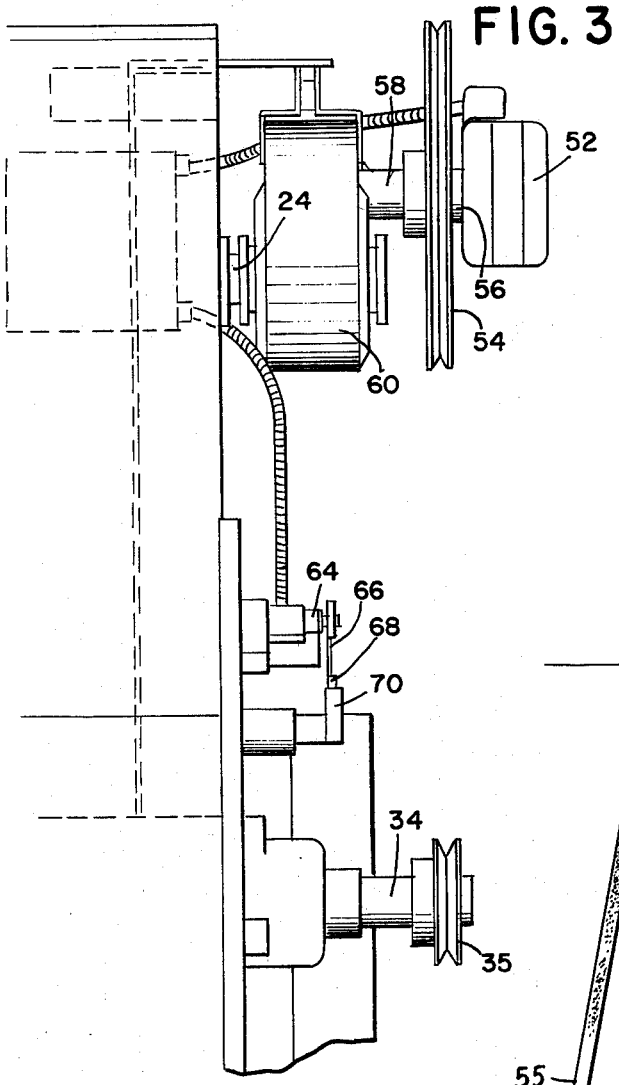
FIG. 4
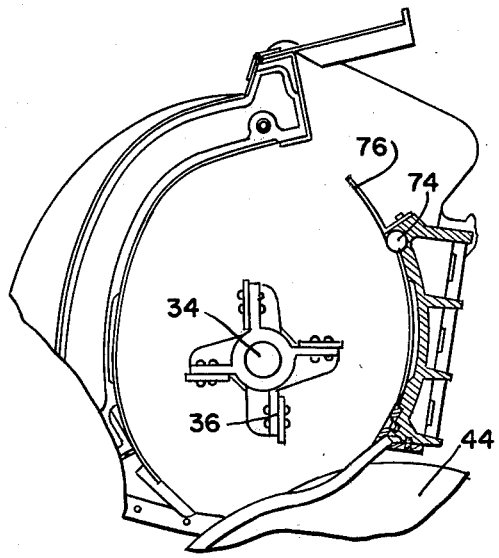
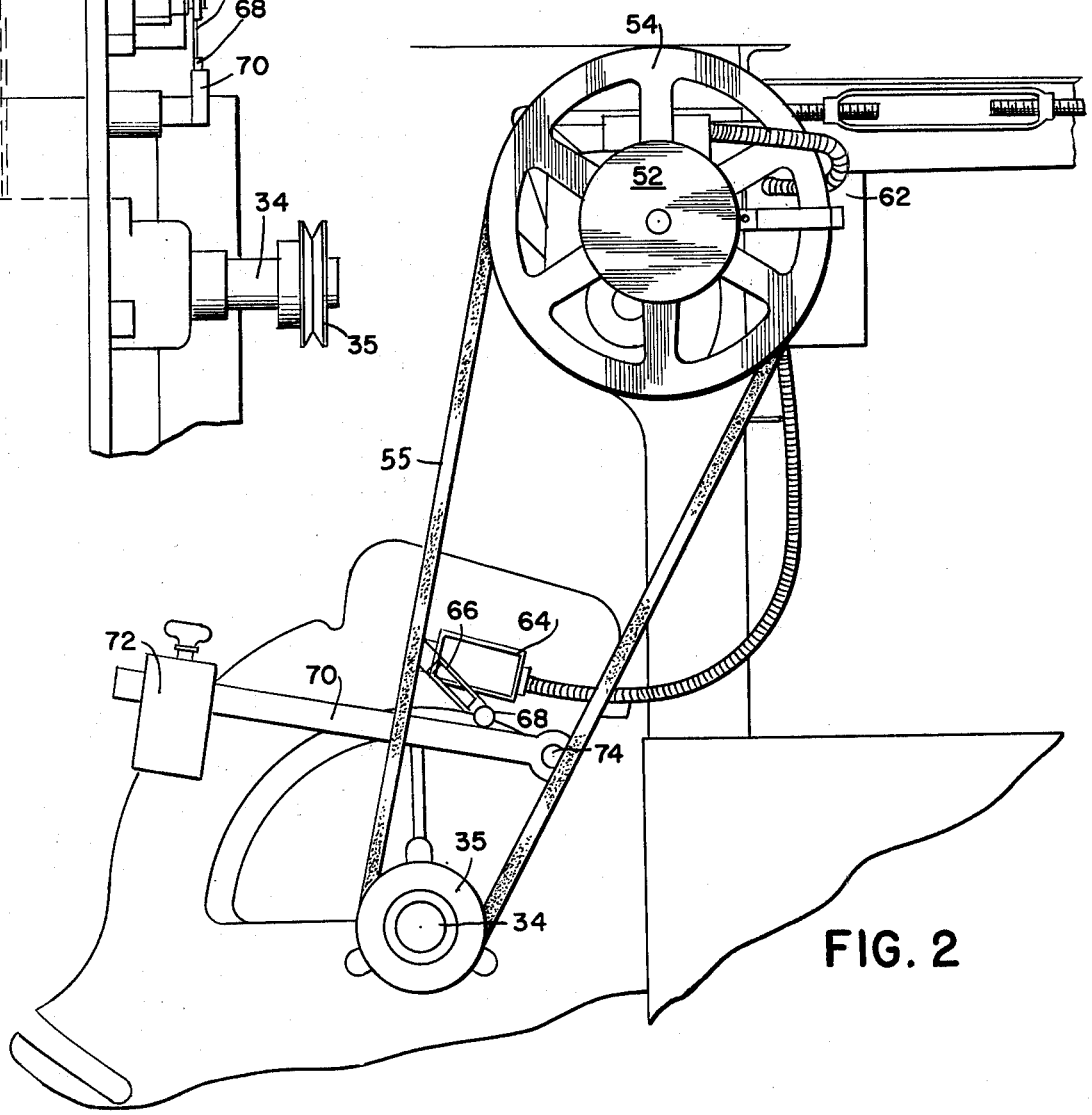
FIG. 2

ELECTRIC CLUTCH FEEDER DRIVE FOR SEED COTTON PROCESSING MACHINERY

BACKGROUND OF THE INVENTION

Cotton processing machines such as cottonseed delinters and cotton gins utilize rotating saws to remove the cotton from the cotton seed. A large number of circular saws are mounted on a common horizontal axis for rotation as an integral unit about the axis. The saws are spaced-apart axially so that there is an axial space between each adjacent pair of saws. A gratefall having a large number of spaced-apart parallel members is positioned during machine operation such that the parallel members extend through respective axial spaces between the saws, there being as many parallel members as there are axial spaces.

For proper operation, it is essential that the entire gratefall be properly positioned relative to the preipheral portions of the circular saws. A gratefall adjusting mechanism is described in U.S. Pat. No. 3,490,101.

A cottonseed delinting machine requires a variable speed feeder to maintain the correct amount of seed in the gratefall—preventing overload or underload conditions.

Existing feeds use ratchet and pawl mechanisms, either in single arrangements such as for standard capacity linters, or in double arrangements for standard capicity linters or for high capacity linters.

In one example a ratchet is mounted on a feed roll shaft and has a shield frame arrangement on one hub and a rocker arm arrangement on the opposite hub. A high capacity model has rocker arms on both hubs.

The shield frame position is governed by a connecting rod attached to a density weight arm located at the end of the gratefall. The arm is connected to a full length curved section in the gratefall which follows a roll of cottonseed. As the seed roll decreases, the weight arm drops, which in turn pulls the shield frame forward, exposing more teeth of the ratchet to engagement by the pawl.

The pawl pivots on one end of the rocker arm which is oscillated by an eccentric and connecting rod arrangement located on a countershaft.

The counter shaft is driven with a flat belt drive from one end of a float shaft. The drive requires an idler as the location of the driving pulley is periodically adjusted to allow for wear in the operating members.

When the cottonseed enters the gratefall from the feeder, the density curve will gradually rise, moving the shield frame to the rear and allowing less of the ratchet to be exposed to the pawl until it is completely disengaged. The ideal arrangement is to have the speed exactly adjusted for a uniform engagement and flow of material. In practice, this is almost impossible to accomplsih with existing feed drives.

Cottonseed processing machinery has an automatic variable speed feeder. Cottonseed flows through a chute into a hopper and out of the hopper onto a gratefall adjacent turning saw blades. A curved section coextensive with the gratefall overlies the gratefall and urages the cottonseed toward the gratefall and saw blades. The sensing means of a switch detects movement of a weighted arm urging the curved section toward the gratefall. A float shaft is rotated between the gratefall and the curved section in the cottonseed roll. Pulleys drive one part of an electric clutch from the clutch shaft. The other part of the electric clutch when energized connected the first part to the speed reducer which in turn drives the feed roll shaft. When the limit switch senses movement of the arm, indicating a movement of the curved section toward the gratefall, a reduced cottonseed roll, and the need for faster feed, the switch energizes the clutch, driving the feed roll from the float roll via the electric clutch and speed reducer. When the curved section returns outward, the switch causes the clutch to disengage.

These and further objects and features of the invention are apparent in the disclosure which includes the above and on-going specification in claims and the drawing.

SUMMARY OF THE INVENTION

The new drive accomplishes the variable speed and uniform feed by means of an electric clutch, a shaft mounted speed reducer and a limit switch. The clutch is driven in an idling condition by a V-belt and sheave arrangement, with the driving sheave being mounted on one end of the float shaft. No idler arrangement is required, as the take-up is done by means of the adjustable torque arm of the speed reducer.

The electric clutch is engaged by means of a limit switch mounted on the gratefall head casting. The limit switch has an adjustable length roller actuator which is also adjustable on the switch shaft. This allows great flexibility in contacting the density weight arm which controls the cottonseed roll in the gratefall. The limit switch operates with little motion of the weight arm; the clutch is quickly engaged, which immediately operates the shaft mounted speed reducer. The cottonseed roll is quickly brought to the desired condition, and the limit switch then causes the clutch to disengage. A typical installation has shown that the clutch is engaged only one-fifth of the time, allowing the same sheave specifications to be used on all linters regardless of whether arranged for first-cut, second-cut or third-cut.

The present invention has the advantages over the ratchet and pawl design and provides: more responsive feed, resulting in more uniform seed roll, less maintenance of operation, few replacement parts, less noise in operation, and more flexible range of feed without parts change.

OBJECTS OF THE INVENTION

One object of the invention is the provision of a cotton processing machine including stationary support structure, a saw cylinder comprising a plurality of axially spaced apart circular saws supported by the stationary support structure for rotation about a fixed horizontal axis, and a gratefall including a plurality of parallel members extending in axial spaces between adjacent saws partially above the fixed horizontal axis of rotation, a feed hopper and feed chute mounted on the support structure in communication with the gratefall for feeding connected cotton fibers and cottonseeds to the gratefall, a feed roll shaft having a feed roller and paddles mounted in the hopper and turnable for feeding cottonseed and fibers to the gratefall, a float shaft positioned above the gratefall parallel to the horizontal axis on which the saw cylinder is mounted, a density curve overlying the gratefall and the float shaft to urge cottonseeds and fibers toward the float shaft and gratefall and an arm connected to the means for urging the means toward the float shaft and gratefall, an electric clutch drivingly connected to the feed roll shaft for connecting a drive to the feed roll shaft and control means connected to the arm for controlling engagement of the electric clutch when the arm moves toward the float shaft and the gratefall.

Another object of the invention is the provision of a cotton processing machine feeder mechanism as described with a speed reducer connected between the clutch and the feed roll shaft for reducing speed between the drive means and the feed roll shaft.

A further object of the invention is the provision of a cotton processing machine with a feeder mechanism which has a drive interconnecting a float shaft and an electric clutch whereby the float shaft drives a speed reducer and feed roll shaft upon drive energization of the electric clutch.

Another object of the invention is the provision of a seed cotton processing machine with a feeder mechanism wherein a control comprises a microswitch having a lever actuator and a roller at the end of the lever actuator remote from the microswitch, the roller contacting a density curve arm and actuating and closing the switch upon movement of the arm toward a float shaft and gratefall.

Another object of the invention is the provision of a feeder drive apparatus for cottonseed processing machinery having a chute for receiving cottonseed, a hopper connected to the chute for holding cottonseed, a feed shaft mounted in the hopper and extending therefrom, a feed roll having paddles mounted on the feed shaft, drive means connected to the feed shaft for driving the feed shaft and feed roll to feed cottonseed out of the hopper, a gratefall positioned beneath the hopper for receiving cottonseed and parallel rotary saws partially extending through the gratefall for removing lint from the cottonseed in the gratefall, urging means positioned above the gratefall for receiving cottonseed from the hopper between the urging means and the gratefall and for urging cottonseed toward the gratefall and circular saws, sensing means connected to the urging means for sensing movement of the urging means towards the gratefall and circular saws, and switch means connected to the sensing means and connected to the drive means for starting the drive means and thereby turning the feed shaft and feed roll to flow cottonseeds from the hopper toward the gratefall upon the sensing means sensing movement of the urging means toward the gratefall and circular saw blades.

A further object of the invention is the provision of the feeder drive apparatus as described wherein the drive means comprises an electric clutch and wherein the switch completes a circuit to energize the electric clutch.

Another object of the invention is the provision of the processing feeder drive apparatus having a float shaft extending between a density urging means and the gratefall and wherein the drive means comprises means for drivingly connecting the float shaft to one side of the electric clutch and means for connecting another side of the electric clutch to the feed shaft.

A further object of the invention is the provision of the feeder drive apparatus as described wherein the drive includes a speed reducer connected between a second side of the electric clutch and the feed roll.

A BRIEF DESCRIPTION OF THE DRAWINGS

FIG. 2 is a side elevational detail of seed cotton feeder apparatus of the present invention.

FIG. 3 is a front elevation of the detail shown in FIG. 2.

FIG. 4 is an internal detail showing the float and density curve.

DETAILED DESCRIPTION OF THE DRAWINGS

Figure 1:
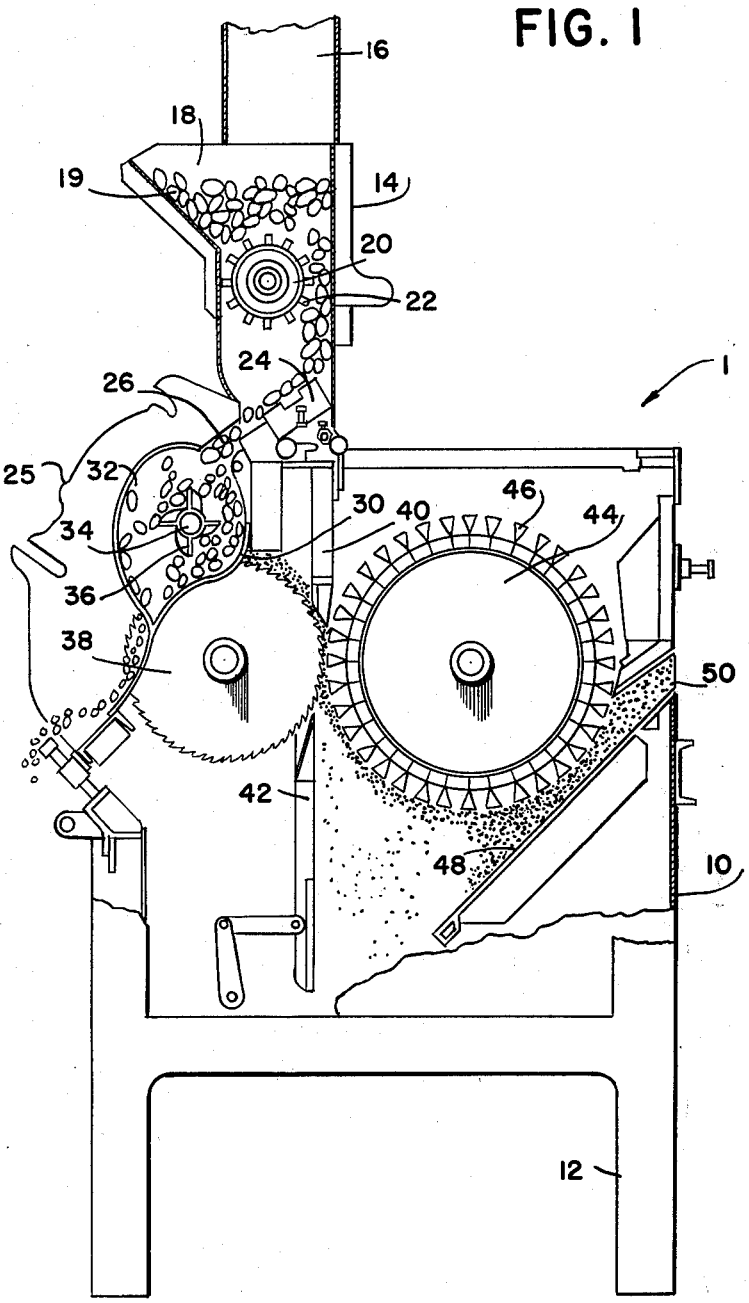
FIG. 1 is a schematic representation of a linter.

Referring to FIG. 1, a cottonseed linter is generally referred to by the numeral 1. The machine has a body 10 with legs 12.

A feeder 14 includes a feed chute 16 and a hopper 18 filled with cottonseeds 19 having lint attached.

Feed roll 20 with paddles or blades 22 extend across the hopper and is mounted on feed roll shaft 22 to rotate with the shaft.

The cottonseed flows from the hopper 18 into the delinting body 25 through passage 26. Gratefall 30 is made of a number of individual similarly curved elements positioned between adjacent saw blades. The seed roll 32 within gratefall 30 is urged in the counterclockwise direction by the combined action of float shaft 34 which rotates float paddles 36 in a counterclockwise direction and by saw blades 38 which together with the float draw the seed adjacent the saw blades. Division board 40 and draft shield 42 separate the saw chamber on the left from the mote chamber on the right.

Brush 44 rotates in the mote chamber on the right.

Brush 44 rotates in a counterclockwise direction while bristles 46 remove lint from the saw blades. Lint is directed by mote board 48 through passage 50.

As shown in FIG. 2, float shaft 34 has a pulley 35 which drives pulley 54 through a belt 55. An electric clutch 52 such as for example, a clutch which may be manufactured by Warner Electric Brake and Clutch Company of Beloit, Wis., is mounted on support shaft 56 to connect a pulley 54 to the input shaft 58 of speed reducer 60. The output of the speed reducer 60 is connected to the feed roll shaft 24. Clutch 52 receives power from power supply 62 which is controlled by a limit switch 64. Limit switch 64 has an adjustable arm 66 with a roller 68 which bears upon density arm 70. An adjustable position weight 72 is connected to arm 70 and the other end of arm 70 is connected to a rod 74 which extends through the dilinter. A density curve segment 76 is attached to the rod. As the teeth of saw 44 and float 36 drive the patent roll upward between the saw and the float, the seed roll presses against density curve 76 tending to rotate the density curve 76 and rod 74 and arm 70 clockwise. As the seed roll is diminished, less upward pressure is applied on density curve 76, and the curve and rod 74 and arm 70 tend to rotate downward. Roller 68 and switch arm 66 follow the downward movement turning switch 64 on and causing clutch 52 to engage. Pulley 54 locks to the input shaft 58 of speed reducer 60, driving feed roll shaft 24. Movement of arm 70 is slight and the response of the feed roll is substantially instantaneous.

While the invention has been described with reference to specific embodiments, it will be obvious to those skilled in the art that modifications and variations of the invention may be made without departing from the scope of the invention. The scope of the invention is defined in the following claims.

What is claimed is:

1. In a cotton processing machine including stationary support structure, saw cylinder comprising a plurality of axially spaced apart circular saws supported by the stationary support structure of rotation about a fixed horizontal axis, and a gratefall including a plurality of parallel members extending in axial spaces between adjacent saws partially above the fixed horizontal axis of rotation, a feed hopper and feed chute mounted on the support structure in communication with the gratefall for feeding connected cotton fibers and cottonseeds to the gratefall, a feed roll shaft having a feed roller and paddles mounted in the hopper and turnable for feeding cottonseed and fibers to the gratefall, a float shaft positioned above the gratefall parallel to the horizontal axis on which the saw cylinder is mounted, means overlying the gratefall and the float shaft to urge cottonseeds and fibers toward the float shaft and gratefall and an arm connected to the means for urging the means toward the float shaft and gratefall, the improvement comprising an electric clutch drivingly connected to the feed roll shaft for connecting a drive to the feed roll shaft and control means connected to the arm for controlling engagement of the electric clutch when the arm moves toward the float shaft and the gratefall, a speed reducer connected between the clutch and the feed roll shaft for reducing speed between the drive means and the feed roll shaft, means to drive the float shaft, and drive means interconnecting the float shaft and the electric clutch whereby the float shaft drives the speed reducer and feed roll shaft upon drive energization of the electric clutch.

2. In a cotton processing maching including stationary support structure, saw cylinder comprising a plurality of axially spaced apart circular saws supported by the stationary support structure for rotation about a fixed horizontal axis, and a gratefall including a plurality of parallel members extending in axial spaces between afjacent saws partially above the fixed horizontal axis of rotation, a feed hopper and feed chute mounted on the support structure in communication with the gratefall for feeding connected cotton fibers and cottonseeds to the gratefall, a feed roll shaft having a feed roller and paddles mounted in the hopper and turnable for feeding cottonseed and fibers to the gratefall, a float shaft positioned above the gratefall parallel to the horizontal axis on which the saw cylinder is mounted, means overlying the gratefall and the float shaft to urge cottonseeds and fibers toward the float shaft and gratefall and an arm connected to the means for urging the means toward the float shaft and gratefall, the improvement comprising an electric clutch drivingly connected to the feed roll shaft for connecting a drive to the feed roll shaft and control means connected to the arm for controlling engagement of the electric clutch when the arm moves toward the float shaft and the gratefall, wherein the control means comprises a microswitch having a lever actuator and a roller at the end of the lever actuator remote from the microswitch, the roller contacting the arm and actuating and closing the switch upon movement of the arm toward the float shaft and gratefall.

3. The feeder mechanism of claim 2 further comprising a speed reducer connected between the clutch and the feed roll shaft for reducing speed between the drive means and the feed roll shaft.

4. The feeder mechanism of claim 3 further comprising means to drive the float shaft, and drive means interconnecting the float shaft and the electric clutch whereby the float shaft drives the speed reducer and feed roll shaft upon drive energization of the electric clutch.

5. Feeder drive apparatus for cottonseed processing machinery comprising a chute for receiving cottonseed, a hopper connected to the chute for holding cottonseed, a feed shaft mounted in the hopper and extending therefrom, a feed roll having paddles mounted on the feed shaft, drive means connected to the feed shaft for driving the feed shaft and feed roll to feed cottonseed out of the hopper, a gratefall positioned beneath the hopper for receiving cottonseed and parallel rotary saws partially extending through the gratefall for removing lint from the cottonseed in the gratefall, urging means positioned above the gratefall for receiving cottonseed from the hopper between the urging means and the gratefall and for urging cottonseed toward the gratefall and circular saws, sensing means connected to the urging means for sensing movement of the urging means towards the gratefall and circular saws, and switch means connected to the sensing means and connected to the drive means for starting the drive means and thereby turning the feed shaft and feed roll to flow cottonseeds from the hopper toward the gratefall upon sensing means sensing movement of the urging means toward the gratefall and circular saw blades, a float shaft extending between the urging means and the gratefall and wherein the drive means comprises an electric clutch with means for drivingly connecting the float shaft to one side of the electric clutch and means for connecting a second side of the electric clutch to the feed shaft, and wherein the switch means completes a circuit to energize the electric clutch.

6. The feeder drive apparatus of claim 5 wherein the drive means further comprises a speed reducer connected between the second side of the electric clutch and the feed roll.

* * * * *